US005791478A

United States Patent [19]

Kalvelage et al.

[11] Patent Number: 5,791,478

[45] Date of Patent: Aug. 11, 1998

[54] PACKAGE ASSEMBLY FOR DISPENSING PHARMACEUTICAL MEDICATIONS

[75] Inventors: John D. Kalvelage, Decatur, Ga.; Ian E. Salditch, Owings Mills, Md.

[73] Assignee: Multi-Comp, Inc., Owings Mills, Md.

[21] Appl. No.: 985,741

[22] Filed: Dec. 5, 1997

[51] Int. Cl.[6] ..... B65D 83/04

[52] U.S. Cl. ..... 206/531; 206/534.1; 206/539

[58] Field of Search ..... 206/528, 531, 206/532, 534.1, 534.2, 538, 539, 1.5

[56] References Cited

U.S. PATENT DOCUMENTS

| | | | |
|---|---|---|---|
| 2,784,539 | 3/1957 | Silver . | |
| 2,834,456 | 5/1958 | Langer . | |
| 3,324,995 | 6/1967 | Sharp, Jr. . | |
| 3,523,608 | 8/1970 | Miller . | |
| 3,856,144 | 12/1974 | Kelly . | |
| 3,933,245 | 1/1976 | Mullen . | |
| 3,941,248 | 3/1976 | Moser et al. . | |
| 3,948,393 | 4/1976 | Lewi . | |
| 4,039,080 | 8/1977 | Cappuccilli . | |
| 4,318,477 | 3/1982 | Kerpe . | |
| 4,416,375 | 11/1983 | Braverman et al. . | |
| 4,664,262 | 5/1987 | White . | |
| 4,972,657 | 11/1990 | McKee . | |
| 4,974,729 | 12/1990 | Steinnagel | 206/534.1 |
| 5,129,517 | 7/1992 | Hustad . | |
| 5,150,793 | 9/1992 | Tannenbaum | 206/539 |
| 5,234,107 | 8/1993 | Morel et al. . | |
| 5,251,757 | 10/1993 | Relyea et al. . | |
| 5,265,728 | 11/1993 | Allendorf et al. . | |
| 5,377,839 | 1/1995 | Relyea et al. . | |
| 5,390,796 | 2/1995 | Kerfoot, Jr. . | |
| 5,489,025 | 2/1996 | Romick . | |
| 5,582,317 | 12/1996 | Wermund . | |

*Primary Examiner*—Jacob K. Ackun
*Attorney, Agent, or Firm*—Millen, White, Zelano, & Branigan, P.C.

[57] ABSTRACT

A package assembly for dispensing pharmaceutical medications comprises a plurality of individually sealed blisters and a relatively stiff frame having a plurality of apertures through which the blisters protrude. The blisters are made up of a plastic sheet having a medication receiving recess and a substantially planar shoulder portion. Sealed to this planar shoulder portion is a lidding sheet. The blisters each further comprise a ridge or other releasable interengagements that are engageable with the portion of the frame defining the apertures through which the blisters protrude.

11 Claims, 2 Drawing Sheets

PACKAGE ASSEMBLY FOR DISPENSING PHARMACEUTICAL MEDICATIONS

BACKGROUND OF THE INVENTION

The present invention relates generally to an improved package assembly for dispensing pharmaceutical medications. More particularly, the present invention relates to blister sheets wherein individual blisters contain tablets.

Blister sheets for packaging medications are widely used in the health care industry. The individual blisters carry set doses of medication, so there is less likelihood of accidents resulting from taking improper dosages. Further, a patient can see what they are taking through the blister sheet to visually confirm that it is the proper medication. Also, typically, there is information printed on the backing sheet behind the blister to likewise confirm the identify of the specific type of medication. Prior patents that describe many features and advantages of blister packages include U.S. Pat. Nos. 5,014,851 and 5,323,907. These patents are incorporated herein by reference as if set forth in their entirety.

In practice, particularly at health care facilities, blister packages are commonly used for maintaining medications for patients. These medications are dispensed into dosage cups and then given to the patients as required. This practice is not entirely efficient because the medications must be dispensed from the package into the cup before they are delivered to a patient. In addition to the actual task of having to do this, the removal of the medications from the package separates the medications from information regarding the medications. It is possible to have mistakes in the actual delivery to the patient if there are multiple patients being provided for.

One solution to the foregoing problem has been for a care provider to dismantle a package, for instance, like that shown in U.S. Pat. No. 5,014,851, and to separate a single blister from the sheet. The blister is then used to deliver the medication to the patient. Because the blister includes information regarding the medication on the backing sheet, this information is immediately at hand for the patient and the care provider. It is less likely for the care provider to make mistakes with the administration of the medication. The problem with this practice is that it is clumsy to take the package assembly apart and put it back together each time. The frame is needed because the sheet is otherwise too flimsy to conveniently handle. On the other hand, the frame must be dismantled each time in order to have access to the blister sheet and separate off a blister.

SUMMARY OF THE INVENTION

It is an object of the present invention to overcome the foregoing drawbacks and provide a package assembly for dispensing pharmaceutical medications in a convenient and safe manner. This new package assembly is designed to allow individual blisters to be removed from a frame so that the medications in each individual blister can be safely carried by a patient or transported to a patient. This and other objects will be evident from the specification, drawings and appended claims in this application.

The present invention is directed to a package assembly having individually sealed blisters mounted in a frame configured as a grid wherein the individually sealed blisters are adapted to be individually discharged from the frame.

The present invention is a package assembly for dispensing pharmaceutical medications comprising a plurality of individually sealed blisters and a relatively stiff frame having a plurality of apertures through which the blisters protrude. The blisters are made up of a plastic sheet having a medication receiving recess and a substantially planar shoulder portion. Sealed to this planar shoulder portion is a lidding sheet. The blisters each further comprise a ridge or other releasable interengagements that are engagable with the portion of the frame defining the apertures through which the blisters protrude.

In another embodiment, the invention includes a package assembly for dispensing pharmaceutical medications comprising a plastic sheet having a plurality of medication receiving recesses formed therein and with substantially planar shoulder portions disposed between the recesses and along the peripheral portions of the sheet. Pharmaceutical medications are positioned in the recesses of the plastic sheet, and a lidding sheet is positioned in an overlying relationship to the plastic sheet. The lidding sheet is secured to the shoulder portions to thereby close the recesses and encapsulate the medications therein. There is also a relatively stiff frame having a plurality of apertures through which the recesses protrude. The recesses further comprise releasable interengagements for releasably securing the recesses to the frame. The package assembly may further include a backing sheet having printed information thereon pertaining to the medication in each of the recesses. The printed information located on the backing sheet corresponds to the arrangement of recesses and is secured to the lidding sheet with the printed information located in registration with the medications in the recesses.

DETAILED DESCRIPTION OF A PREFERRED EMBODIMENT

Figure 1:
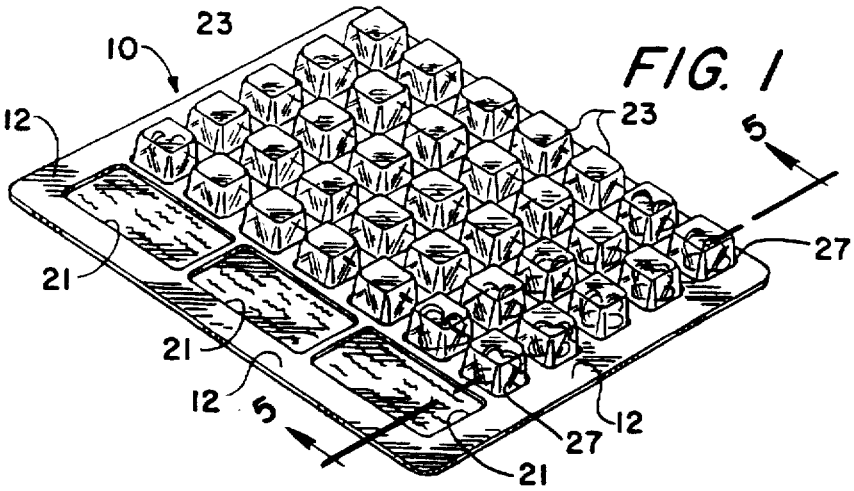
FIG. 1 is a perspective view of a blister package assembly embodying the present invention.

Turning first to FIG. 1, there is shown a preferred embodiment of a package assembly 10 which embodies the present invention. The package assembly 10 is made up of a number of different components including a blister package 22 which comprises a plastic sheet 11, an overlying lidding sheet 16, and a backing sheet 14 overlying the rear surface 17 of the lidding sheet. The plastic sheet 1 1 has a plurality of blister recesses 23 formed therein, and the assembly further includes a relatively stiff frame 12 in the form of a grid with openings therethrough. The blister recesses 23 of the plastic sheet 11 are arranged in a pattern, and the frame 12 has apertures 27 or openings that correspond to and receive respective ones of the blister recesses. Preferably, the blister recesses 23 are arranged in a matrix of rows and columns that correspond to a calendar or some other schedule convenient for a particular patient. The frame 12 also has windows 21 that allow portions of the backing sheet 14 of the blister package 22 to be visible. Writing or other indicia appears on this visible portion of the backing sheet 14 that preferably gives all of the information or labeling requirements of the pharmaceutical medications such as tablets 13, that are sealed in each of the blisters of the package.

Figure 2:
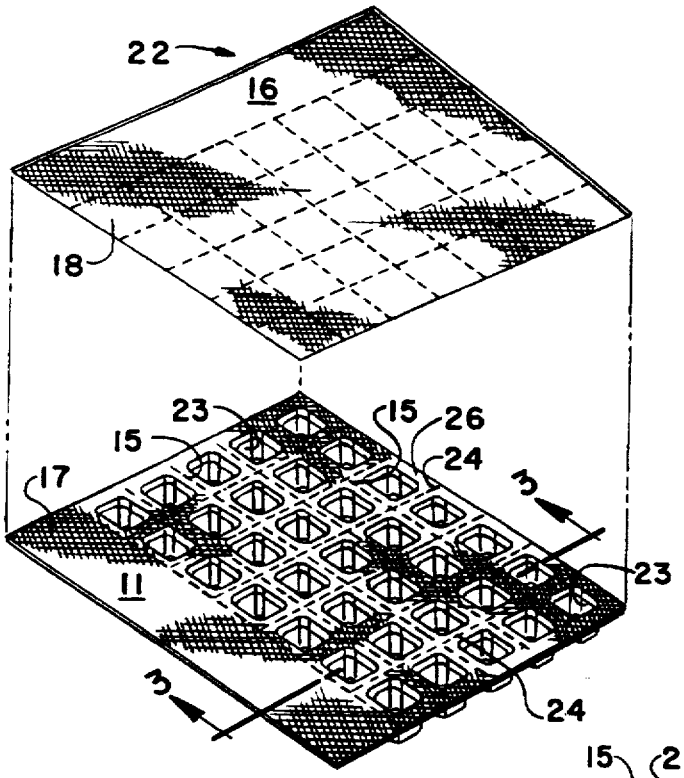
FIG. 2 is an exploded view of the plastic sheet and lidding sheet embodying the present invention.

As best seen in FIG. 2, the blister package 22 includes the plastic sheet 11 and the lidding sheet 16. The plastic sheet 11 is formed from a flat, clear plastic sheet of a suitable transparent thermoplastic polymer such as polyvinylcholoride or polyethyleneterepthalate which has been thermoformed or die-molded to form the pattern of the blister recesses 23. The blister recesses 23 are arranged in a plurality of columns and rows and are separated by substantially planar shoulder portions 15. The peripheral portions 26 of the sheet 11 adjacent the edges of the sheet are also substantially flat and planar. As illustrated, score lines 24 or perforations are provided in the shoulder portions 26 of the plastic sheet 11 to form pre-weakened areas to facilitate separating the individually sealed blisters or blister recesses 23 from the package. This scoring proximate each individually sealed blister allows a patient's unused medications 13 in the individually sealed blisters to be separated easily from the package 10 and recycled or reused in other package assemblies. Alternatively, a patient may separate out a subset of the blisters and carry one or more doses separate from the package. In a further alternative, the blisters may be separated by a health care provider and delivered from, for instance, a nurses station to a patient's bedside.

Figure 3:
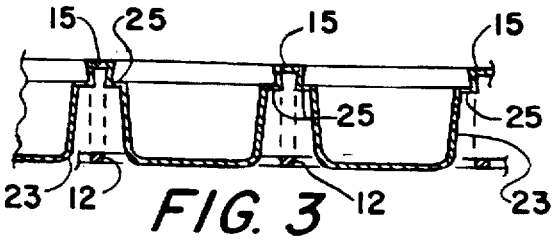
FIG. 3 is a fragmentary sectional side view taken along line 3—3 in FIG. 2.
Figure 5:
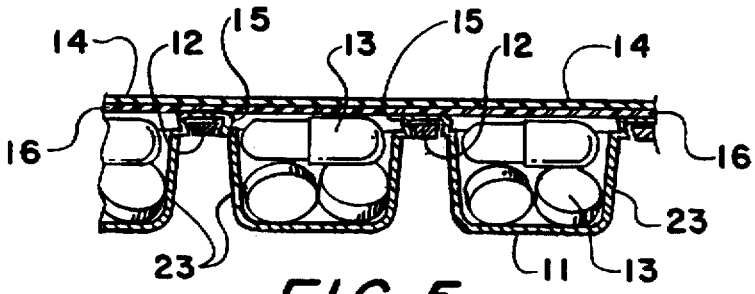
FIG. 5 is a fragmentary sectional side view of the package and taken along line 5—5 of FIG. 1.

FIGS. 3 and 5 illustrate the shape of the individual recesses 23 that make up the plastic sheet. The recess 23 is shown to have a generally rectangular shape; however, the geometry of the recess may vary depending on the number and shape of the medications expected to be carried in the recess. There is also shown a ridge 25 that is formed near the planar shoulder portions 15 and about the circumference of the recess 23. This ridge 25 has the shape and circumference to match the shape and circumference of the apertures 27 in the frame 12. The ridge 25 engages the frame 12 and holds the frame in place around the recesses. As shown, the portion of the frame 12 defining the apertures 27 is formed so that the side wall that extends the thickness of the frame is not perpendicular to the flat surfaces of the frame. This angled or beveled portion is formed to fit the shape of the portion of the recess 23 that makes up the ridge 25. The flexible nature of the plastic sheet 11 allows the recesses 23 to snap into place into the relatively stiff frame 12, so the plastic sheet or the individually sealed blisters are is retained on the frame by only the mechanical interengagement therewith.

The ridge 25 illustrated is one type of releasable interengagements for releasably securing a blister to the frame. Other types of configurations may be formed into the plastic sheet and/or the frame to releasably secure them together. For instance, there may be one or more protrusions in the blister recess, or there may be snaps that join the planar shoulder portions to the frame. Those of skill in the art will know of other variations that could comprise interengagement.

The thermoplastic polymer that makes up the plastic sheet 11 must have sufficient barrier properties to prevent the diffusion of unwanted moisture and oxygen into the blister recesses 23 of the package that may spoil or deactivate the packaged medications 13. This barrier property may be formed by including a barrier layer in a plastic sheet 11 before it is thermoformed or pressed into the blister sheet form. The method of forming the sheet 11 and the various compositions of the sheet are well known in the industry.

The lidding sheet 16 is made of frangible material, typically relatively thin and flexible metal foil or plastic film that has barrier properties like those discussed above to ensure the hermetic preservation of medications sealed in the package. Alternatively, the lidding sheet 16 may be made of the same type of material as the plastic sheet so that the package would be uniformly recyclable.

The upper surface of the shoulder portions 15 including the peripheral portions 26 of the plastic sheet 11 are coated with a means 17 and 18 for securing the lidding sheet 16 to the plastic sheet. This means 17 and 18 for securing the lidding sheet 16 to the plastic sheet 11 include pressure sensitive adhesives, heat activated adhesives, cohesives, and any other type of coating for securing the sheets together. This coating can be applied by conventional methods and, alternatively, may be applied to the entire surface of the plastic sheet 11 in the case of a cohesive. See U.S. Pat. No. 5,014,851. Also, the coating can be applied before or after the plastic is formed or molded into the plastic sheet 11. The surface of the lidding sheet 16 may also be coated with means for securing the lidding sheet to the plastic sheet 11. Preferably, a cohesive coating is used on both the plastic sheet and the lidding sheet so that the coating will not adhere to any medications contained in the package. Rather, the cohesives will only adhere to themselves. As used herein, the term "cohesive" refers to the ability of the coating to securely attach to and adhere to other surfaces coated with the same material or compatible cohesive material, yet have no bonding or adherent properties with other surfaces.

Figure 4:
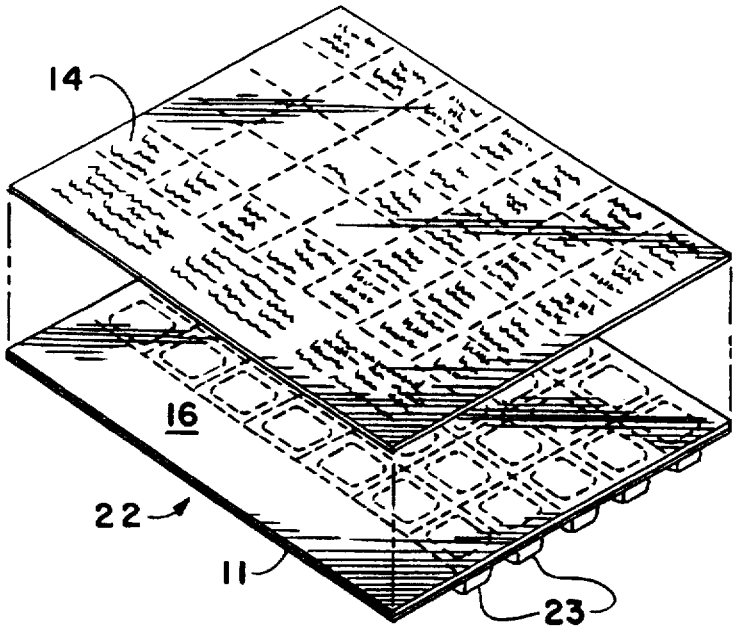
FIG. 4 is a perspective view of the plastic sheet, lidding sheet and backing sheet embodying the present invention.

Referring now to FIG. 4, a backing sheet 14 can be applied to the rear surface of the lidding sheet 16 of the blister package 22. The backing sheet 14 is preferably coated with an adhesive or other glue material for adhering the backing sheet to the lidding sheet 16. The backing sheet 14 is preferably made of paper, because it is desirable to print information on the side of the backing sheet opposite the side having the adhesive and that relates to the packaged medications. The printed information, that can be written, typed or generated by a computer printer, sets forth required pharmaceutical labeling information, and the printed information is in registry with respective ones of the blister recesses. Thus, the specific contents of each blister recess may be set forth in matrix form that corresponds to the blister recesses of the package when the backing sheet is applied to the lidding sheet. In another embodiment, the material that makes up the lidding sheet 16 is also printable, so the printed information can be displayed on the lidding sheet 16 without the need for a backing sheet 14.

Contrary to earlier pharmaceutical packaging systems, the present invention allows a patient or a health care provider to easily snap out or separate a blister from the package—the blister being a single blister recess having medications sealed within it by a lidding sheet with or without an additional backing sheet. The patient may then carry one or more of these blisters or doses without having to carry the entire package. Similarly, where regulations require that medications be given to patients in a plastic cup, the individual blisters can serve the purpose of being that plastic cup in which the medications are given to a patient. Another advantage of this system is that the lidding sheet or backing sheet sealing the blister will contain information regarding the medication and allow the health care provider or the patient to confirm that the proper medication is being taken.

While a particular embodiment of the invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

That which is claimed is:

1. A package assembly for dispensing pharmaceutical medications comprising:

a plurality of individually sealed blisters that contain medications and a relatively stiff frame having a plurality of apertures through which the blisters protrude, the blisters each comprising a plastic sheet having a medication receiving recess and a substantially planar shoulder portion, and a lidding sheet wherein the lidding sheet is sealed to the shoulder portion of the plastic sheet, the blisters each further comprising a ridge formed in the recess and releasably engageable with the portion of the frame defining the apertures through which respective blisters protrude, whereby the blisters are releasably secured to the frame.

2. A package assembly according to claim 1 wherein each blister further comprises a backing sheet having printed information thereon pertaining to the medication contained in each blister and means for securing the backing sheet to the lidding sheet.

3. A package assembly for dispensing pharmaceutical medications comprising a plastic sheet having a plurality of medication receiving recesses formed therein and with substantially planar shoulder portions disposed between the recesses and along peripheral portions of the sheet;

pharmaceutical medications positioned in said recesses of said plastic sheet;

a lidding sheet positioned in an overlying relationship to the plastic sheet; the lidding sheet being secured to the shoulder portions to thereby close the recesses and encapsulate the medications therein;

a relatively stiff frame having a plurality of apertures through which the recesses protrude; and the recesses further comprising releasable interengagements for releasably securing the recesses to the frame.

4. A package assembly according to claim 3 wherein the plastic sheet further includes a matrix of preweakened lines in the shoulder portions and around each recess.

5. A package assembly according to claim 3 further comprising a backing sheet having printed information thereon pertaining to the medication in each of the recesses, the printed information being located on the backing sheet in locations corresponding to the arrangement of recesses, and the backing sheet being secured to the lidding sheet with the printed information located in registration with the medications in the recesses.

6. A package assembly according to claim 3 wherein the lidding sheet is secured to the shoulder portions by adhesive.

7. A package assembly of claim 3 wherein the relatively stiff frame is a single unitary element disposed on one side of the plastic sheet.

8. A package assembly for dispensing pharmaceutical medications comprising a plurality of individually sealed blisters and a relatively stiff frame having a plurality of apertures through which the blisters protrude, the blisters each comprising a plastic sheet having a medication receiving recess and a substantially planar shoulder portion, and a lidding sheet wherein the lidding sheet is secured to the shoulder portion of the plastic sheet, and the blisters each further comprising releasable interengagements for releasably securing the blister to the frame.

9. A package assembly for dispensing pharmaceutical medications comprising:

a plastic sheet having a plurality of individually sealed blisters;

a single frame in the form of a stiff grid having openings therethrough, through which openings project the individually sealed blisters, and interengagements between the frame and individually sealed blisters for releasably holding the blisters in the frame wherein the blisters can be individually dislodged from the frame.

10. A package assembly according to claim 9 wherein the plastic sheet is scored proximate each individually sealed blister to facilitate dislodgement of the blisters.

11. A package assembly according to claim 9 wherein the plastic sheet is retained on the frame by only the mechanical interengagements therewith.

* * * * *